United States Patent [19]

Mulcahy

[11] 4,370,933

[45] Feb. 1, 1983

[54] RAILWAY CAR TRUCK BOLSTER ASSEMBLY

[75] Inventor: Harry W. Mulcahy, Griffith, Ind.

[73] Assignee: AMSTED Industries Incorporated, Chicago, Ill.

[21] Appl. No.: 251,398

[22] Filed: Apr. 6, 1981

[51] Int. Cl.[3] ..... B61F 5/06; B61F 5/12; B61F 5/50

[52] U.S. Cl. ..... 105/197 DB; 105/207

[58] Field of Search ..... 105/197 DB, 207

[56] References Cited

U.S. PATENT DOCUMENTS

| | | | |
|---|---|---|---|
| 2,378,414 | 6/1945 | Light | 105/197 DB |
| 2,986,101 | 5/1961 | Tack et al. | 105/197 DB |
| 4,084,513 | 4/1978 | Bullock | 105/197 DB |

*Primary Examiner*—Robert B. Reeves
*Assistant Examiner*—Howard Beltran
*Attorney, Agent, or Firm*—Edward J. Brosius; Fred P. Kostka; Tony T. Shu

[57] ABSTRACT

A railroad car truck includes a pair of spaced side frames carrying therebetween a transversely positioned bolster. Ends of the bolster are positioned within a window formed in each side frame. A connection between the side frame and bolster includes an interposed set of springs which cushions vertical movements of the bolster. These movements are dampened by sets of friction shoes which interact with wear surfaces formed as part of the bolster and side frame. The bolster-side frame connection also accommodates pitching and yawing movements of the bolster and pitching movements of the side frames. These rotational movements are not cushioned and can produce substantial stresses when contact occurs between abutting structural members of the bolster and the side frames. To maintain such stresses below the yield point of the structural members, bolster-side frame contact is restricted to areas of the bolster where the stresses may be distributed to members having sufficient strength.

1 Claim, 4 Drawing Figures

RAILWAY CAR TRUCK BOLSTER ASSEMBLY

BACKGROUND OF THE INVENTION

1. Field of Invention

This invention relates to railroad car trucks and more particularly to an improved connection between the truck side frames and the truck bolster.

2. Prior Art

Modern railroad car trucks used to support a body of a railroad car are commonly referred to as a 3-piece truck. The truck includes a pair of wheelsets having axle ends journaled in bearings positioned in pedestal jaws formed at ends of a pair of spaced side frames. Each side frame in turn has a centrally located window in which a set of springs carries ends of a transversely positioned bolster. The springs cushion vertical movements of the bolster which in turn supports the railroad car body.

Connections between the bolster ends and side frames most often include sets of friction shoes to dampen vertical oscillating movements of the bolster which are inherent with coil spring suspension. The friction shoes are carried in pockets formed back-to-back in each bolster end. This back-to-back positioning of the pockets results in a substantially reduced section modulus of the bolster between the pockets.

In addition to vertical movements of the truck bolster, the bolster also yaws and pitches in response to changes in direction during travel of the truck. These latter movements of the bolster are not cushioned and can result in contact between abutting structural members of the bolster and the side frame. Contact also occurs when the side frames pitch in response to irregularities in track height. The dynamic and static forces related to truck travel are of such a high magnitude that when contact does occur, stresses of high value are created. Because of the reduced section modulus of the bolster between the friction shoe pockets, this portion of the bolster may be stressed close to or even beyond its yield point. Thus, the bolster can become subject to fatigue failure and permanent deformation.

SUMMARY OF THE INVENTION

A railroad car truck includes a pair of spaced side frames each having a centrally located window. Each window in turn is defined by an upper compression member, a lower tension member and spaced front and rear connecting sidewalls. To these sidewalls are fastened replaceable wear plates.

On each bottom tension member is a set of coil springs. These spring sets in turn carry ends of a bolster transversely positioned between the side frames. Each bolster end extends through a respective side frame window to form a connection therebetween.

The bolster has an elongated hollow configuration defined by a top wall, a bottom wall and front and rear sidewalls. In each bolster end is a set of front and rear facing friction shoe pockets positioned back-to-back. Each pocket contains a friction shoe which aligns with the side frame window wear plates to engage the wear plate and dampen vertical oscillating movements of the bolster. Such oscillating is an inherent characteristic of coil spring suspension. Edge portions of each wear plate extend laterally beyond the friction shoe pockets to align with inner and outer lands formed as part of the bolster front and rear sidewalls. The inner lands are spaced longitudinally apart a greater distance than the outer lands so that a space between each inner land and a respective wear plate inner edge portion is less than a space between each outer land and a respective wear plate outer edge portion. This positioning results in the bolster outer lands being inwardly offset from the bolster inner lands.

The use of offset or nonaligning inner and outer bolster land sets produces several important results.

First, when the bolster pitches, i.e., rotates about a lateral axis of the truck, contact between the bolster and the side frame is limited to the inner land sets of the bolster and the inner edge portion of the side frame window. This contact tends to twist the bolster to produce torque related stresses within the bolster body. The bolster top, bottom and sidewalls and internal reinforcing ribs, however, have sufficient strength to resist twisting without being damaged. Twisting of the bolster also occurs when the side frames pitch. When side frames pitch in an opposite direction, twisting of the bolster can be severe.

Secondly, when the bolster yaws, i.e. rotates horizontally about a vertical axis of the truck, again contact between the bolster and the side frames is limited to the bolster inner land sets and the side frame window wear plate inner edge portions. This contact tends to bend the bolster to produce bending related stresses within the bolster body. During such bending, the center plate connection between the bolster and railroad car body inhibits movement of a center portion of the bolster. The bolster body is sufficiently strong to endure such bending without sustaining damage.

By this invention, the bolster-side frame connection system has been strengthened without increasing the system mass. Additional reinforcing need not be added to the bolster body proximate the friction shoe pockets since the area of the bolster body remains at relatively low stress levels.

DESCRIPTION OF THE PREFERRED EMBODIMENT

Figure 2:
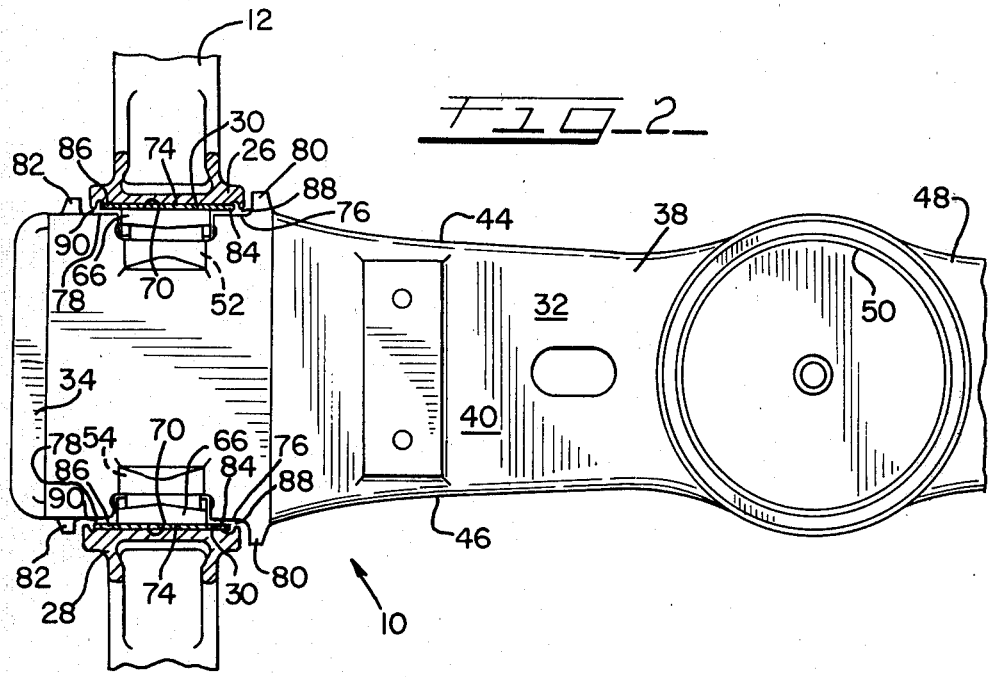
FIG. 2 is a plan view in partial section of a portion of the railroad car truck of FIG. 1.
Figure 1:
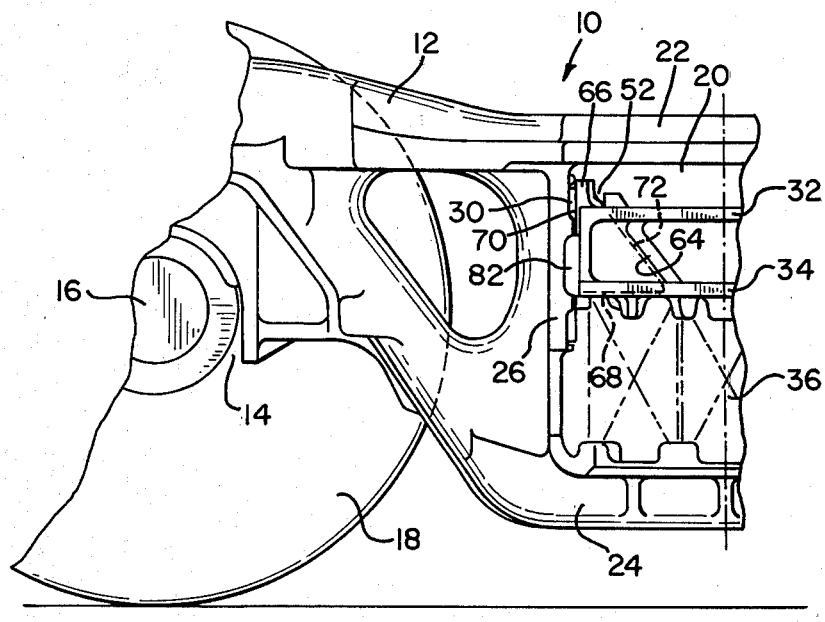
FIG. 1 is a side elevational view of a fragmentary portion of a railroad car truck incorporating this invention.
Figure 3:
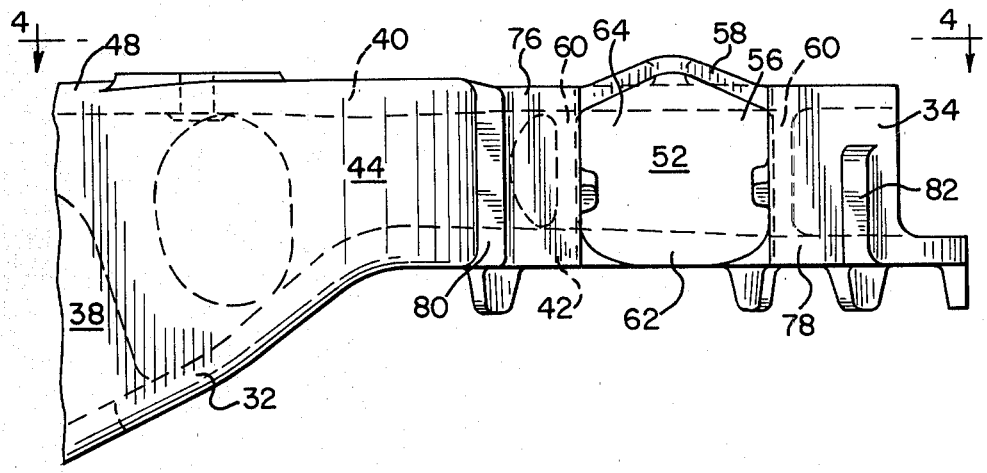
FIG. 3 is an elevational view of an end portion of a bolster of the truck of FIG. 1.

A fragmentary portion of a railroad car truck is shown in FIGS. 1 and 2 and designated 10. The truck 10 includes a pair of spaced side frames with a portion of one such side frame 12 shown. At each end of the side frame 12 is a pedestal jaw 14 in which an axle 16 of a wheelset 18 is journaled. As is understood by those knowledgeble in the art, a truck typically has two such wheelsets.

Centrally located within the side frame 12 is a window 20 defined by an upper compression member 22, a lower tension member 24 and spaced front and rear sidewalls 26, 28. It should be understood that the truck 10 is bi-directional and the term "front" and "rear" are used to facilitate the description of the truck 10. Attached to each window sidewall 26, 28 is a wear plate 30.

The truck 10 further includes a bolster 32 which is positioned transversely between the side frames. End portions of the bolster 32 are disposed in the side frame windows and as shown an end portion 34 of the bolster 32 is located within side frame window 20. On the side frame window compression member 24 is a set of coil springs 36, shown diagrammatically, which resiliently supports the bolster end 34 to cushion vertical movements of the bolster 32.

The bolster 32 has an elongated substantially hollow body 38 defined by a top and a bottom wall 40, 42 joined to a front and rear sidewall 44, 46. In a center portion 48 of the bolster body 38 is a center plate 50 which forms part of a center plate connection with a body of the railroad car (not shown) in a known manner.

Figure 4:
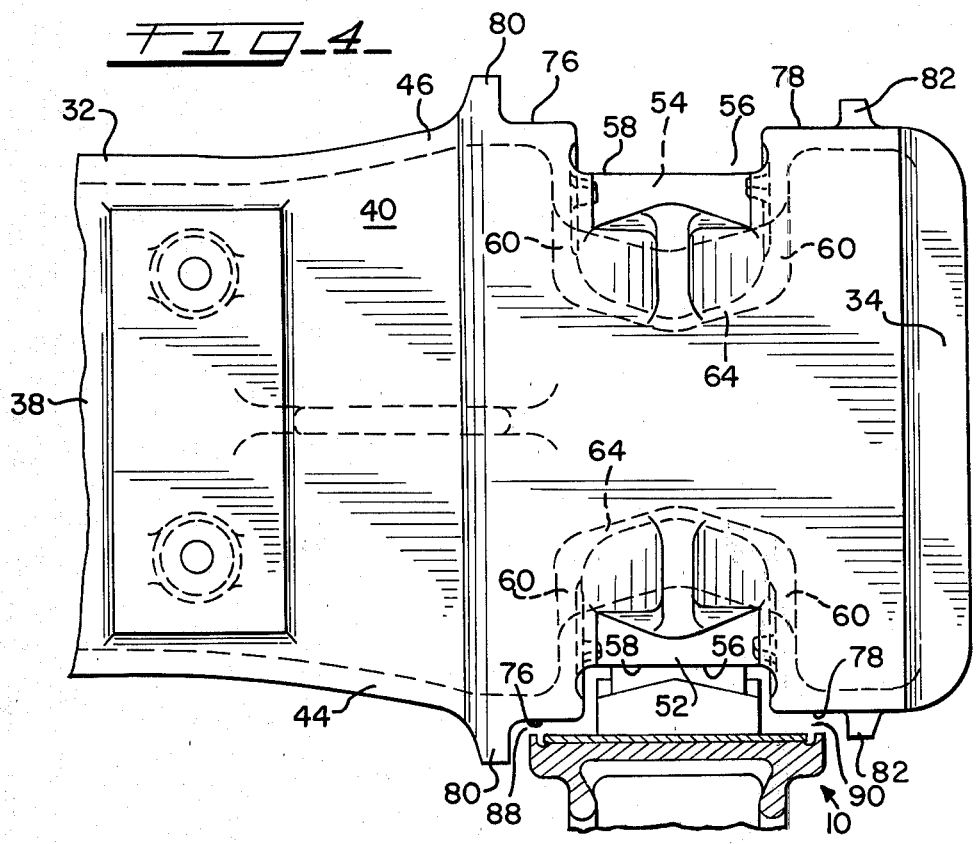
FIG. 4 is a plan view of the bolster end portion as seen generally along the line 4—4 in FIG. 3.

The bolster end outer portion 34 is formed with a front and a rear friction shoe pocket 52, 54 positioned in a back-to-back manner. Each pocket 52, 54 has an outwardly facing opening 56 and is defined by a top member 58, downwardly sloped side members 60, and an inner offset bottom member 62. The top and bottom members 58, 62 may be formed as an integral part of the bolster top and bottom walls 40, 42. These members 58, 62 are recessed into the top and bottom walls 40, 42 to substantially reduce the cross-sectional mass and resulting section modulus of the bolster 32 between the pockets 52, 54. Joining the members 58–62 is a downwardly sloped friction wall 64 which, as shown in FIG. 4, may have an inner concave configuration.

In each pocket 52, 54 is a triangular-shaped friction shoe 66 comprising a horizontal bottom 68, a vertical face 70 and a sloped wear member 72. The bottom 68 of each shoe 66 engages with one of the springs of the spring set 36 to force the shoes 66 upwardly so that the shoe wear members 72 are in contact with the friction shoe pocket friction walls 64. The slope of the friction wall 64 forces the shoes 66 outwardly so that the vertical face 70 of each shoe 66 engages with a center portion 74 of each side frame window wear plate 30.

Formed as part of the bolster front and rear walls 44, 46 on each side of the friction shoe pocket openings 56 is a set of inner and outer lands 76, 78. The land sets 76, 78 are located between inner and outer sets of ribs 80, 82. The inner lands 76 are located a greater distance apart than the outer lands 78 so that the sets 76, 78 are longitudinally offset. The wear plates 30 are sufficiently wide that an inner and outer edge portion 84, 86 of each wear plate 30 aligns with the bolster inner and outer land sets 76, 78. The side frame window sidewalls 26, 28 fit between the bolster rib sets 80, 82. Because the land sets 76, 78 are offset, a space 88 between each inner land 76 and each wear plate inner edge portion 84 is less than a space 90 between each outer land 78 and the wear plate outer edge portion 86.

During operation, the truck 10 is subjected to a complex set of dynamic and static forces. The static forces are primarily gravitational in nature and originate from the railroad car body which may vary from fully empty to full. The dynamic forces originate, for example, during a coupling and uncoupling procedure of the railroad car and during travel of the car because of acceleration, deceleration and changes in direction. This set of forces is reinforced by road bed disrepair and track irregularities. The set of forces causes the bolster 32 and the side frames to move linearly and rotatively in all six directions. Vertical movements of the bolster 32 are regulated by the suspension system comprising the spring sets 36 and friction shoes 66. All other movements of the bolster 32 and the side frames are substantially unregulated but are maintained within set limits by contact between abutting structural members of the side frame 12 and the bolster 32.

For example, the bolster 32 may pitch, i.e. rotate about the lateral axis of the truck 10, in response to forces created during coupling of the railroad car. Additionally, the side frame 12 pitches as a result of track irregularities. This pitch rotation of the bolster 32 and the side frame 12 is limited by contact between the side frame window wear plate inner edge portions 84 with the bolster inner land sets 76. This contact tends to twist the bolster body 38 and can produce substantial torque related stresses therein.

The bolster 32 may also yaw, i.e. rotate horizontally about the vertical axis of the truck 10, in response to hunting forces created by the wheelsets 18. This yawing rotation of the bolster 32 is limited in the same manner as noted above by contact between bolster 32 and the side frame 12. This contact tends to bend the bolster body 38 and can produce substantial bending related stresses.

Note in each case no contact is made between the bolster outer land sets 78 and the side frame window wear plate outer edge portions 86. The portion of the bolster body 38 between friction shoe pockets 52, 54 remain unaffected and thus not under a stress that could result in permanent damage or overtime in a fatigue failure.

While various modifications may be suggested by those versed in the art, it should be understood that I wish to embody within the scope of the patent warranted hereon all such modifications as reasonably and properly come within the scope of my contribution to the art.

What is claimed is:

1. A railroad truck assembly comprising a pair of laterally spaced side frames, a bolster transversely positioned between said side frames with end portions resiliently supported in windows formed in said side frames, each said bolster end portion formed with a pair of longitudinally spaced, in the longitudinal direction of the truck, shoe pockets, each receiving a friction shoe to engage with vertical sidewalls defining said windows, the improvement comprising, a wear liner means disposed on each said sidewall and having its lateral edges extending beyond a width of said friction shoe, an inner and outer set of vertical lands formed as part of said bolster end portions on each lateral side of said shoe pockets such that a longitudinal space between said inner lands and said wear liner means is less than a longitudinal space between said outer lands and said wear liner means, so that during relative movements between said bolster and said side frames, contact therebetween is limited to said bolster inner lands and said wear liner means of said side frames.

* * * * *